US009191728B2

(12) United States Patent
Savant

(10) Patent No.: US 9,191,728 B2
(45) Date of Patent: Nov. 17, 2015

(54) HEADPHONE POWER SYSTEM USING HIGH FREQUENCY SIGNAL CONVERSION

(76) Inventor: Sagar C. Savant, San Jose, CA (US)

( * ) Notice: Subject to any disclaimer, the term of this patent is extended or adjusted under 35 U.S.C. 154(b) by 1019 days.

(21) Appl. No.: 13/252,953

(22) Filed: Oct. 4, 2011

(65) Prior Publication Data

US 2013/0083927 A1 Apr. 4, 2013

(51) Int. Cl.

| | |
|---|---|
| ***H04R 1/00*** | (2006.01) |
| ***H04R 1/10*** | (2006.01) |
| *H04R 3/00* | (2006.01) |

(52) U.S. Cl.

CPC ..... *H04R 1/1025* (2013.01); *H04R 1/1083* (2013.01); *H04R 3/00* (2013.01); *H04R 2460/01* (2013.01)

(58) Field of Classification Search

CPC .... H04R 1/1091; H04R 29/001; H04R 3/005; H04R 1/021; H04R 1/028; H04R 1/1016; H04R 1/1075; H04R 1/24; H04R 1/2811; H04R 1/2853; H04R 1/2857

USPC ..... 381/74, 77, 311, 300, 309, 370, 104, 381/56, 58, 1, 2; 455/130, 370, 350, 100, 455/95, 347

See application file for complete search history.

(56) References Cited

U.S. PATENT DOCUMENTS

| | | | | |
|---|---|---|---|---|
| 6,212,282 | B1 * | 4/2001 | Mershon | 381/77 |
| 8,509,453 | B2 * | 8/2013 | Bychkov et al. | 381/74 |
| 2011/0170703 | A1 * | 7/2011 | Palma | 381/74 |

OTHER PUBLICATIONS

Kuo et al., "Hijacking Power and Bandwidth from the Mobile Phone's Audio Interface", International Symposium on Low Power Electronics and Design (ISPLED'10), 6 pages, Design Contest, Aug. 2010.*

Kuo et al., "Hijacking Power and Bandwidth from the Mobile Phone's Audio Interface", International Symposium on Low Power Electronics and Design (ISLPED'10), 6 pages, Design Contest, Aug. 2010.

* cited by examiner

*Primary Examiner* — Lun-See Lao

(74) *Attorney, Agent, or Firm* — The Gache Law Firm, P.C.; Russell C. Gache

(57) ABSTRACT

An apparatus and method for powering headphone electronics over a standard audio signal cable without interfering with the normal audio transmission or playback of transmitted audio signals. A software application resides on a cell/smart phone or other mobile device that combines the nominal audio output of such a mobile device, like music or spoken word, with a high frequency audio signal to produce a dual component signal. The high frequency component is decoded and rectified outside of the mobile device, either in a connector or on the structure of the headphones themselves, to produce a direct current ("DC") that powers the headphones. The music or other audible signal component transferred over the audio cable is decoded in parallel and sent to the headphone speakers for normal playback. The invention provides an alternative power source to headphone electronics such as active noise cancelling headphones over the audio cable.

8 Claims, 7 Drawing Sheets

HEADPHONE POWER SYSTEM USING HIGH FREQUENCY SIGNAL CONVERSION

FIELD OF THE INVENTION

The present invention relates generally to headphone power systems. In greater particularity, the present invention relates to headphone powering systems for actively powered headphones, such as noise cancelling headphones. In even greater particularity, the present invention relates to the conversion of high frequency signals into direct current power for powering electronics, such as headphones.

BACKGROUND OF THE INVENTION

Noise cancelling and white noise generating headphones have become popular in the last 10 years for actively controlling the output of headphone sound. In particular, noisy environments, such as airplane travel environments, demand active control over audio output in headphones in order to dynamically adjust to varied user environments. However, actively controlling headphone output requires electronics powered within the headphone system. Currently, such electronics cannot be powered by the audio signal that is received by the headphones without unacceptable degradation of the audio signal so such headphones incorporate either a separate power supply, necessitating a separate power wire, or a good set of batteries.

Batteries in headphones add weight and either must be replaced with new batteries or replaced with freshly recharged batteries. Some headphones have attempted to reduce the weight of battery load by using smaller batteries, but this necessitates more frequent chargings, and less available power. And while having a separate power line for headphones is possible, the additional wire is usually unacceptable to the user.

In concert with the advent of powered and active headphones, cell phones and mobile devices, like the iPad and iPod, have become much more powerful, both computationally and in battery strength. Applications can now be written for these platforms in a matter of days with reliable outcomes. Moreover, the dominant music source for music entertainment today is a user's mobile phone, or similar mobile device. Coincidentally, the protocol or format for outputting music through an audio port in a phone or mobile device is standardized. In other words, even though some variation in diameter still exits for mobile device audio ports, the pin configuration and electrical design specifications are universally accepted.

Hence, what is needed is a system and method for using the standardized audio output port in mobile electronics, such as a cell phone, to transfer power to a pair of audio headphones without interfering with the primary purpose of those headphones—for faithful reproduction of music and other audio signals coming from the mobile device.

SUMMARY OF THE INVENTION

The invention consists of a software application that resides on a cell phone or other mobile device that combines the nominal audio output of such a mobile device, like music or spoken words, with a high frequency audio signal to produce a dual component signal. The high frequency component is decoded and rectified outside of the mobile device, either in a connector or on the structure of the headphones themselves, to produce a direct current ("DC") that powers the headphones. The music or audible component is decoded and sent to the speakers in the headphones to reproduce the audible component for the user of the headphones. By producing a DC current for the headphones, power may be supplied to either power electronics on the headphones, such as noise cancelling electronics, or rechargeable batteries may be supplied with power for recharging. An alternate embodiment of the invention provides a module that may be plugged into a standard electrical wall outlet to provide power in the same manner as above using the same audio cable.

Other features and objects and advantages of the present invention will become apparent from a reading of the following description as well as a study of the appended drawings.

BRIEF DESCRIPTION OF THE DRAWINGS

A headphone power system incorporating the features of the invention is depicted in the attached drawings which form a portion of the disclosure and wherein.

DESCRIPTION OF THE PREFERRED EMBODIMENTS

Figures 1, 1A:
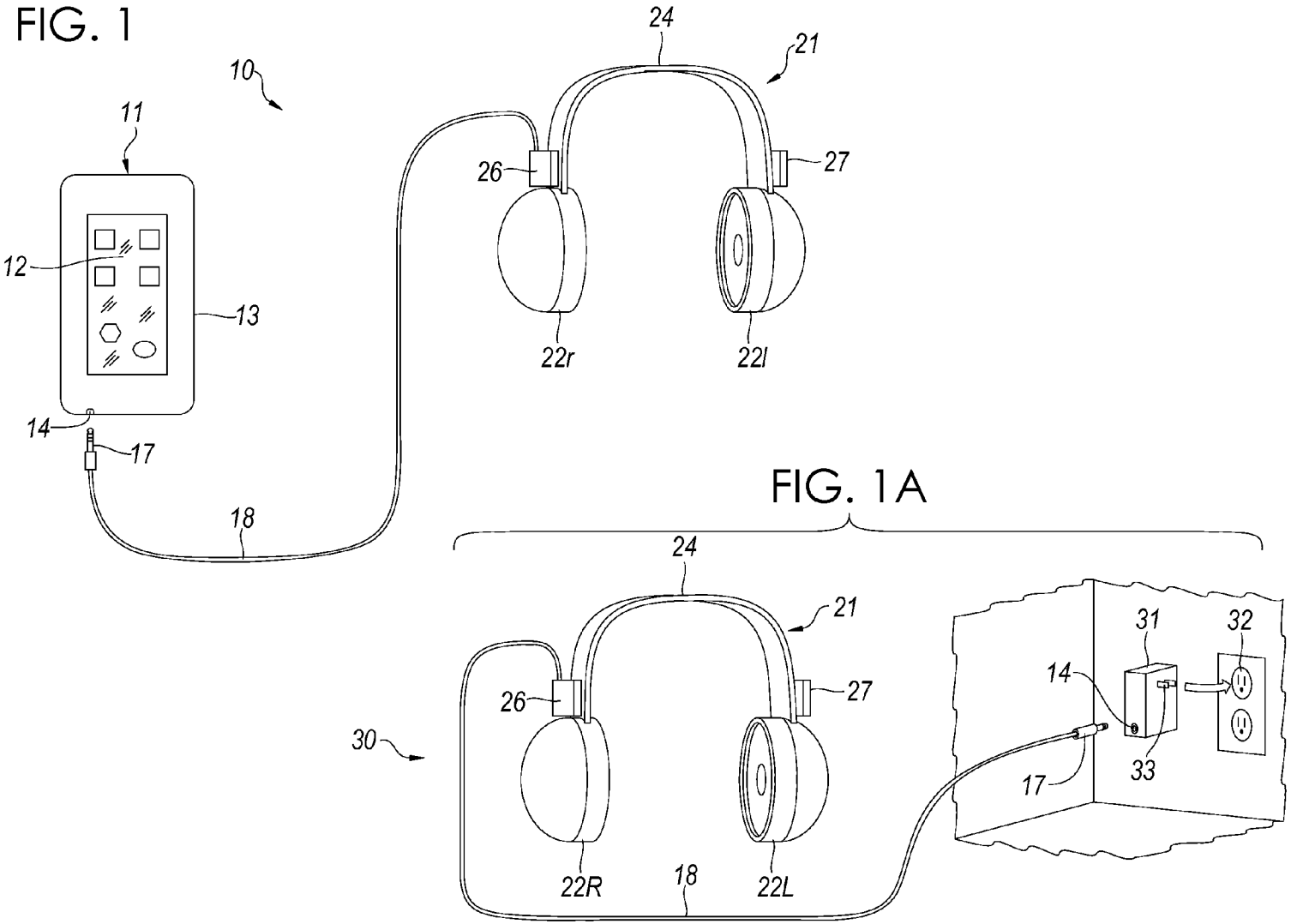
FIG. 1 is a diagram showing the general configuration of the invention.
FIG. 1A is a diagram showing the general configuration of another embodiment of the invention.

FIG. 1 shows a general configuration of the invention when configured to work with an iPod®, iPod Touch®, iPhone®, or similar mobile electronic device. The Invention 10 works in conjunction with the standard capabilities of mobile devices that are capable of outputting audio signals listened to by a user. All such mobile devices have software applications that are either resident in firmware memory and may be loaded for execution into the mobile device's random access memory ("RAM"), or applications that are transferred from outside the device and retained in static RAM or miniature hard drives and transferred into dynamic RAM ("DRAM") for execution by one or more processors or processing cores. Such applications are routinely downloaded from virtual application stores on the Internet, such as Apple's Apps Store®, and transferred from a synchronization program from a PC such as iTunes® or other program. Further description of the process of the downloading applications and the running of those applications on mobile devices shall be omitted as the mechanics and technology associated with such processes is well known and not necessary for a complete understanding of the herein described invention.

Electronic device 11 includes the capability to play music or the spoken word through a software application 13 as part of its nominal functionality, with the control and generation of such output being controlled through a touch screen user interface 12. The output of the application 13 is streamed through audio jack or port 14. Headphones 21 are connected to port 14 through audio connector 17 and wire 18, and a miniaturized electronics enclosure 26 mounted on headphones support 24. Support 24 also connects right and left speakers 22R, 22L, and optionally supports a battery enclosure 27.

Figure 6:
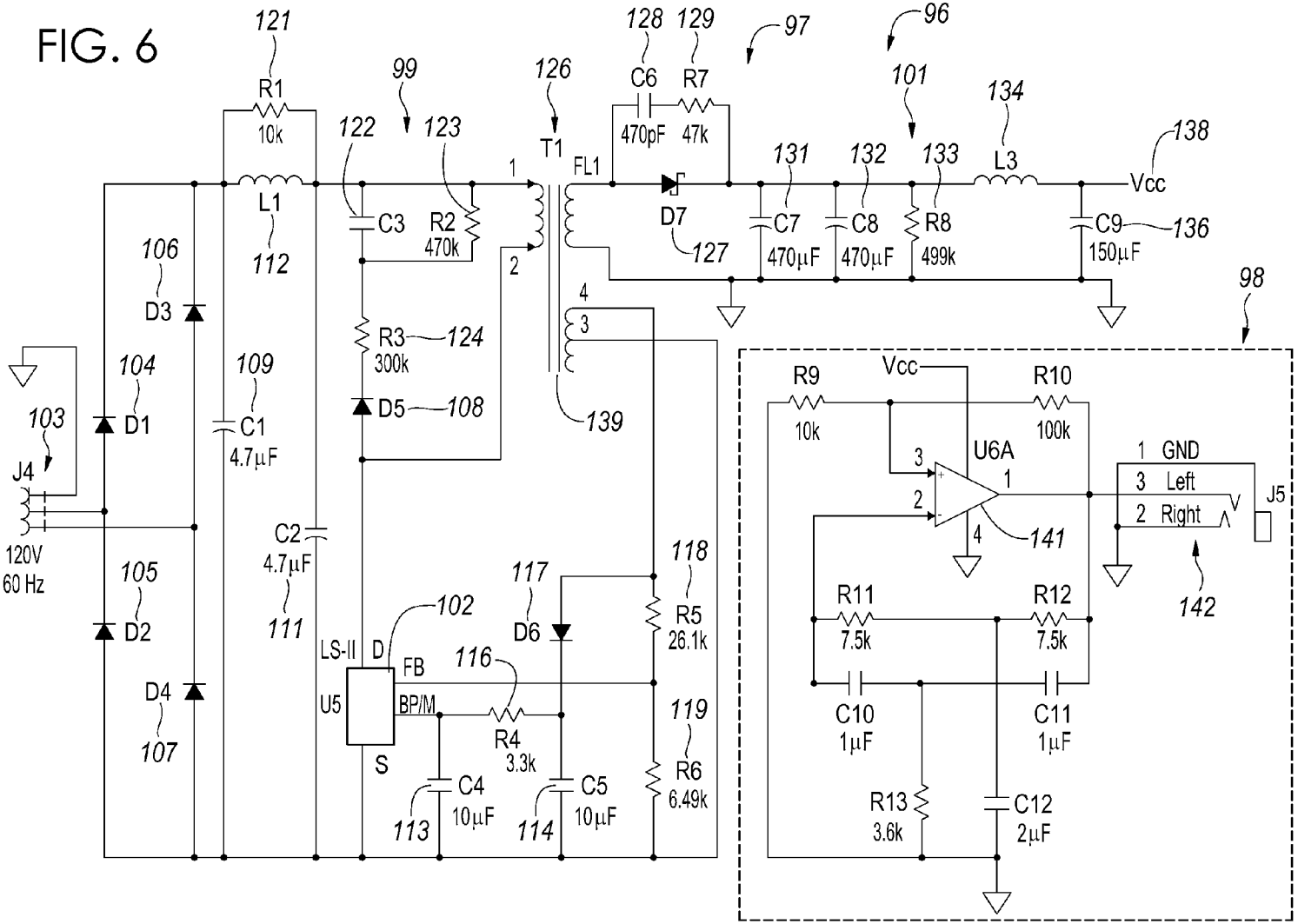

As shown in FIG. 1A, an alternate embodiment of the herein described invention 30 uses all of the above described elements of embodiment 10 except that in place of a mobile device having a processor, a software application, and a user interface, an electronic module 31 is substituted containing signal generating electronics. The module 31 is inserted into a standard household electrical outlet 32 with the usual electrical plugs 33 to power the internal electronics. Audio cable 18 with connector 17 is inserted into an audio jack 14 as with above embodiment 10. However, module 31 has internal electronics only for generating an electrical signal representing an audio tone above the human hearing range, typically 20 kHz to 23 kHz, over cable 18. Essentially, module 31 is providing a charging stimulus from the household AC voltage source. The tone or signal is converted into power in the same manner as with invention 10 through conversion electronics 26. Suitable electronics for module 31 are shown in FIG. 6.

Figure 2:
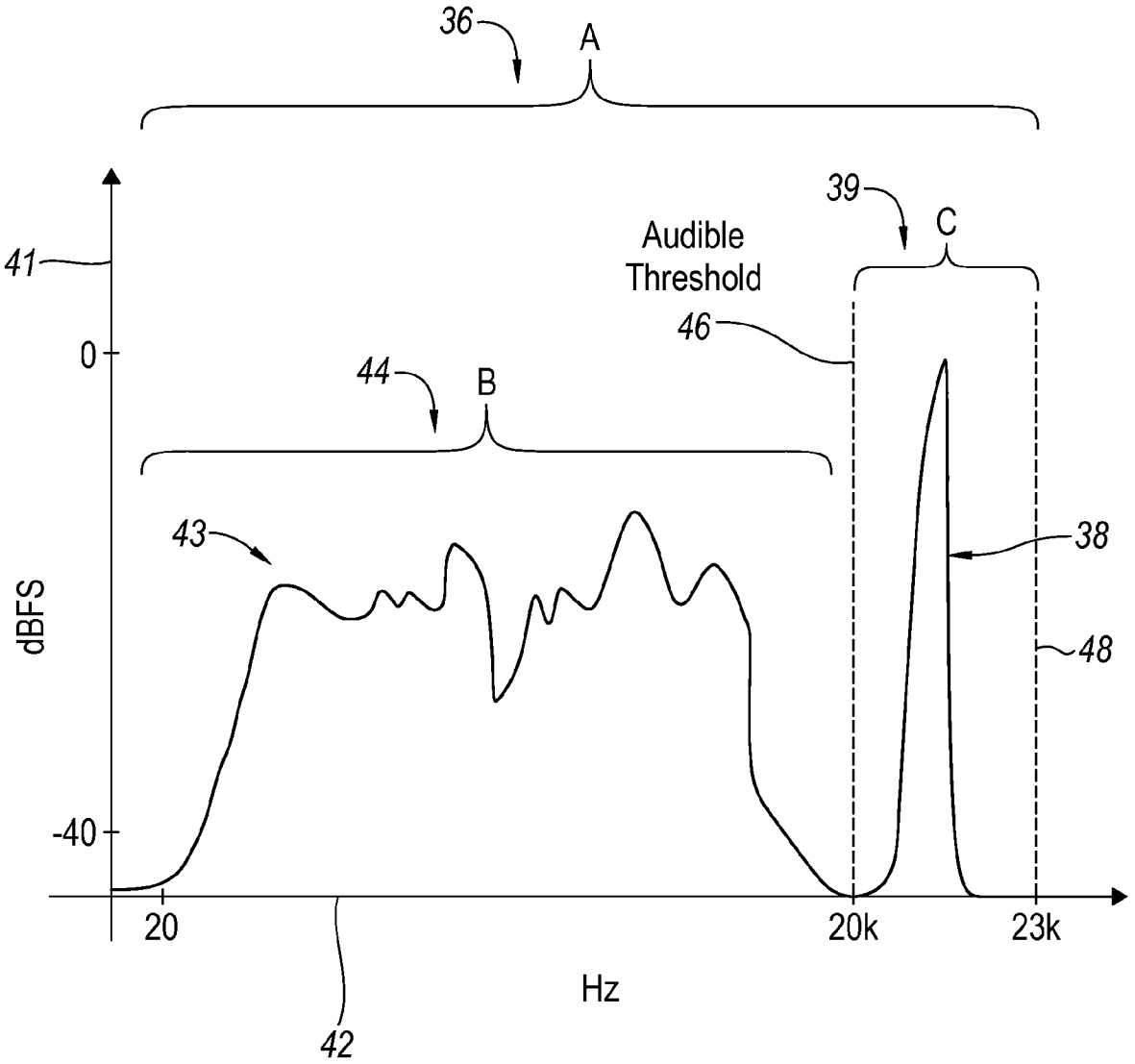
FIG. 2 a wave form graph showing the frequency distribution for the electronic signals of the invention in which music is streamed.

Referring now to FIG. 2, it may be seen a frequency distribution graph 35 of a typical audio music signal as it is transferred to a pair of headphones using the herein described invention 10. The y or vertical axis 41 of the graph 35 is the measure of decibels relative to full scale, commonly abbreviated "dBFS," and the x or horizontal axis 42 is the signal frequency in hertz as shown. Audio signal A (36) is comprised of two signal components or signal portions B (44) and C (39). Signal B (43) represents the audio spectrum of a music signal spanning from approximately 20 Hz to 20 kHz, and a power signal C (39) that spans frequencies from approximately 20 kHz to 23 kHz. Audible threshold 46 separates the two signal components 44 and 39 at 20 kHz, and is a lower threshold for power signal 38. Power signal 38 also has an upper threshold 48 of 23 kHz, although the inventor fully contemplates using higher frequencies to increase power transfer efficiency.

Figure 2A:
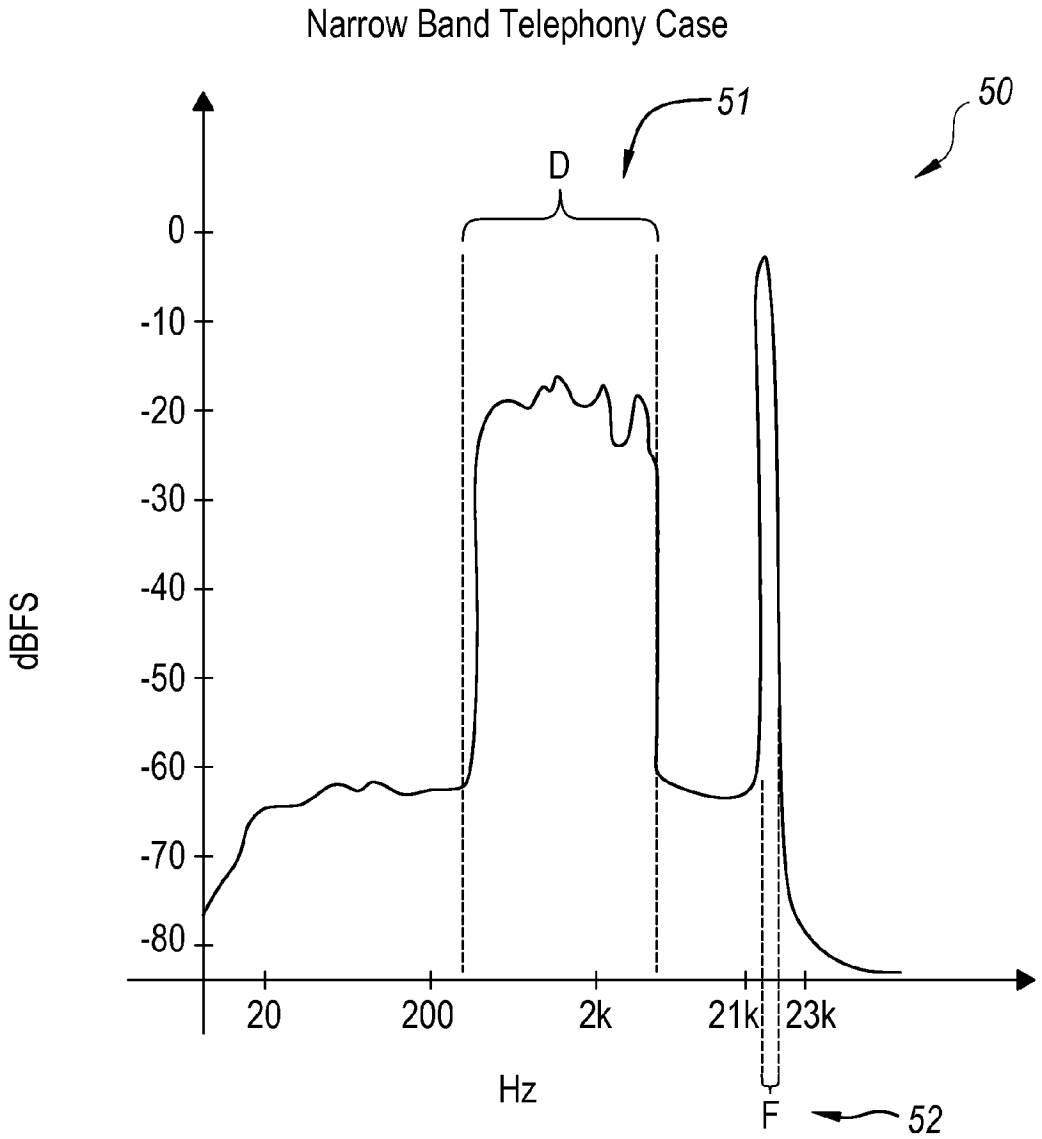
FIG. 2A a wave form graph showing the frequency distribution for the electronic signals of the invention in which a telephone conversation is streamed.

The graph 50 FIG. 2A is similar to FIG. 2 except that audio signal 43 has a limited band region D (51) of from approximately 300 Hz to 3400 Hz, and power signal 38 has been shifted to a frequency range F (52) just above the audio threshold 46.

Figure 3:
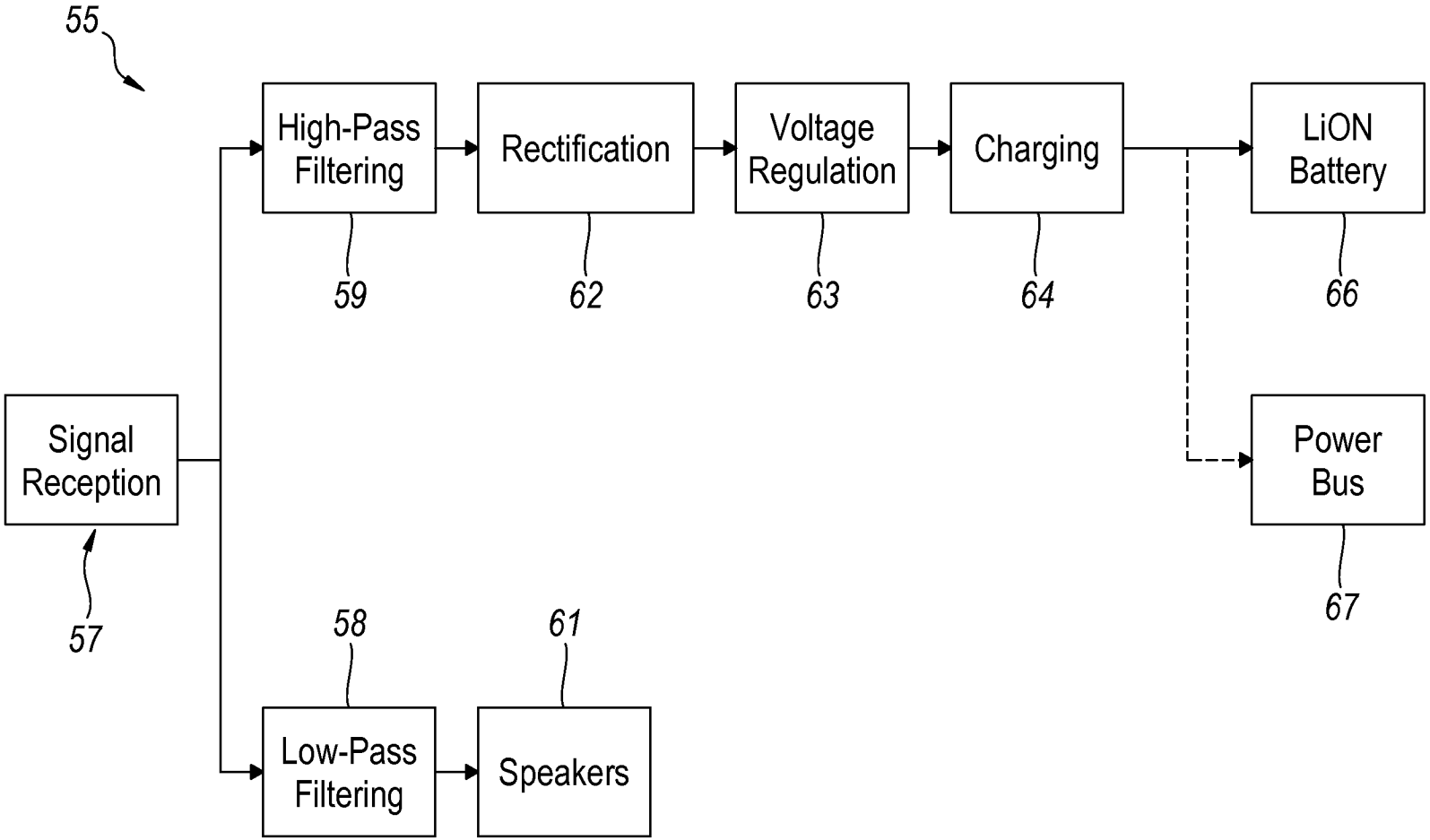
FIG. 3 is a process flow diagram for converting the electrical signal into direct current.

A process 55 for transferring the dual component signal A (36) and extracting power from it may be seen in FIG. 3. The signal 36 is received 57 by electronics 26 and using low-pass 58 and high-pass 59 filters to separate the audio signal component B (44) and the power signal component C (39). After component B (44) is extracted, it can simply be passed 61 to headphone speakers 22L,R for conversion into a human recognized waveform.

Power signal C (39) is rectified 62 and the voltage regulated 63 to meet the needs of the headphone electronics. The voltage produced at 63 can then be used for charging 64 a battery, such as a lithium ion battery 66, or simple connected to the power bus or rail 67 to power noise cancelling electronics for the headphones 21. Because the power signal portion C (39) is above the audible threshold 46, filters 59 and 58 may precisely isolate the power signal 38 and, thereby, not interfere with the accurate reproduction of the audio signal 43.

Figure 4:
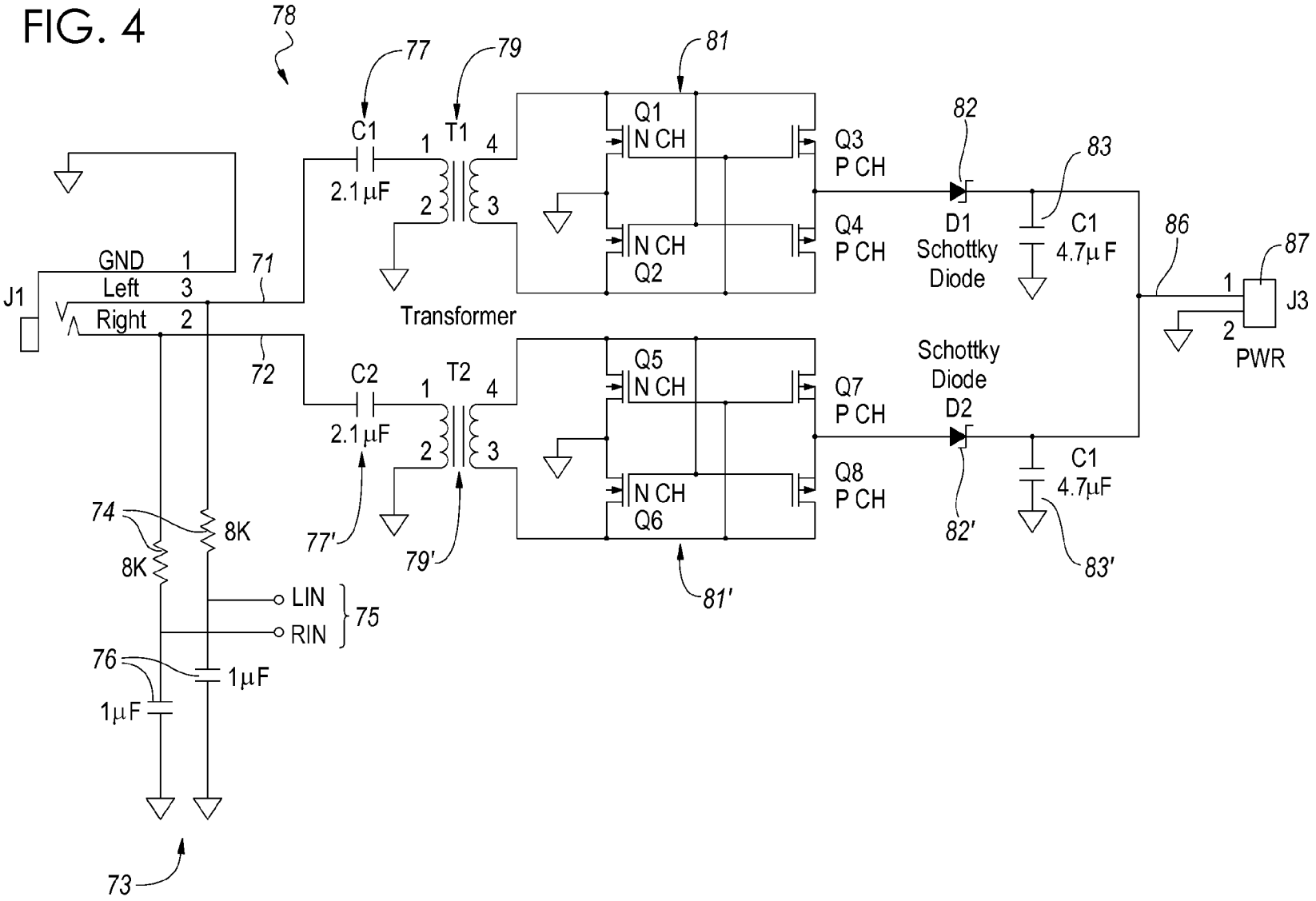
FIG. 4 is a schematic diagram showing the DC conversion circuitry of the invention.

Electronics suitable for filtering out the two component signals B (44) and C (39) are shown in FIG. 4 and disclose element values suitable for the preferred embodiment. Right and left channel lines 71,72 receive the right and left channels of audio signal 43 and pass it to a low pass filter 73. Low pass filter elements, namely resistors 74 and capacitors 76, filter out the power signal which is generally above the human audible hearing range of 20 kHz such that the audio signal component B (44) is passed via left and right channel lines 75 to headphone speakers 21, or to other headphone sound generating electronics such as noise cancelling electronics also connected to the speakers 21.

A high pass filter comprised of a capacitor circuit 77 allows power signal component C (39) to be propagated through power generation circuit 78, thereby screening out audible audio signal component B (44). Power generation circuit 78 includes for each audio channel a micro-transformer 79 for stepping up the voltage of signal component C (39) by approximately 20 times the typically audio voltage. The signal is then rectified with an FET bridge 81 and Schottky diode 82, as shown. Capacitor 83 then acts as a filter DC voltage reservoir to connector 86, that combines the current source capability of each channel to produce a suitable power rail 87 that powers the electronics for headphone 21. The voltages generated by circuit 78 are expected to be in the range of 1.8V to 4V depending on the source input level and the specific mobile device implementation.

Figure 5:
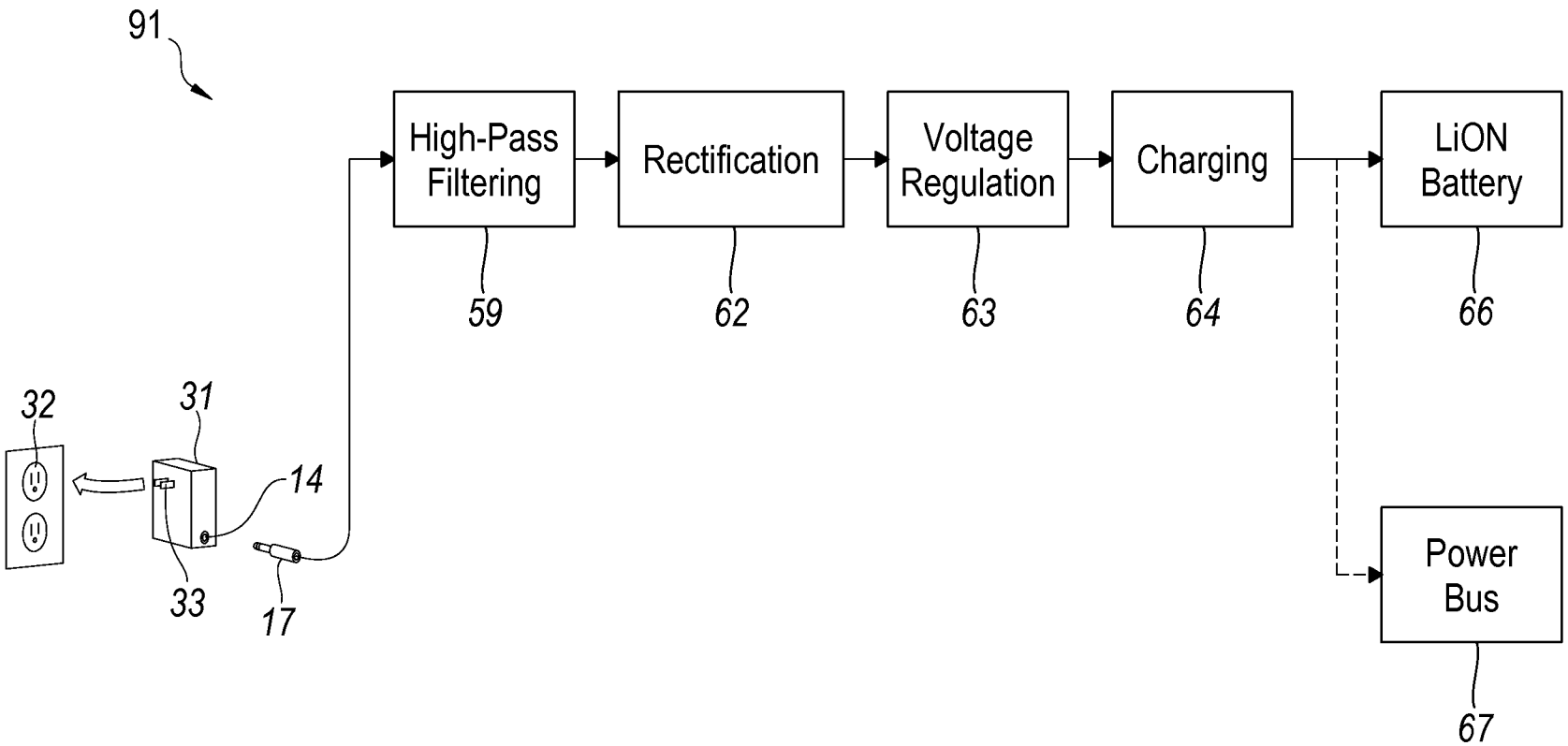
FIG. 5 is a process flow diagram for converting the electrical signal into direct current for another embodiment of the invention; and, FIG. 6 is a schematic diagram showing the circuitry for generating an audio signal from another embodiment of the invention instead of using an iPod to generate the signal.

Referring to FIG. 5, power generation circuit 78 may be utilized with a wall mounted power generation module 31 adapted to generate a power signal 38 to power headphones 21 pursuant to process 91. Power generation circuit 78 is unchanged from process 55 shown in FIG. 3, except that high pass filter elements 77 of 78 are not needed because no low frequency signal component B (44) is transmitted from module 31 to headphones 21. Therefore, process 91 requires no changes to the existing electronics shown in FIG. 4.

A circuit implementation of module 31 shown in FIG. 5 may be seen in FIG. 6, preferably with circuit elements having values as shown in the figure. With module 31 inserted into a household power outlet, sub-circuit 97 takes nominal household 120 Volt AC power and converts it into usable 5 volt DC power. Sub-circuit 98 then uses the generated DC to transmit an audio tone to the electronics 26 located in the headphones 21 for powering the headphones 21.

Sub-circuit 99 in circuit 97 utilizes a standard LinkSwitch™ II monolithic integrated circuit 102 having a high-voltage power MOSFET, oscillator, simple ON/OFF control scheme, a high-voltage switched current source, frequency jittering, with cycle-by-cycle current limit and thermal shutdown circuitry. The IC 102 is manufactured by Power Integrations of San Jose, Calif. House plug connections 103 supply 120 VAC to circuit 99 and is rectified by diodes D1 (104) through D4 (107), and is filtered by the bulk storage capacitors C1 (109) and C2 (111). Inductor L1 (112), with capacitors C1 and C2, form pi ($\pi$) filters to attenuate conducted differential-mode EMI noise. The LinkSwitch-II device U1 (102) allows sufficient voltage margins in universal input AC applications and the circuit 97 is self-powered from a bypass pin via the decoupling capacitor C (113), the value of which programs the cable-drop voltage compensation. In the preferred embodiment, a 10 μF capacitor gives the 350 mV (7% of VNO), the compensation needed for a nominal #24 AWG cable, with 0.35Ω impedance. A bias circuit consists of elements D6 (117), C5 (114), and R4 (116) to increase efficiency and to reduce no-load input power to less than 150 mW. The rectified and filtered input voltage is then applied to one end of the transformer T1 (126) primary winding. The other side of the transformer's primary winding is driven by the internal MOSFET of U1 (102—LS-II). An RCD-R clamp consisting of D5 (108), R2 (123), R3 (124), and C3 (122) limits drain voltage spikes caused by leakage inductance. Resistor R2 (123) has a relatively large value to prevent any excessive ringing on the drain voltage waveform caused by leakage inductance. The LS-II IC (102) samples the feedback winding each cycle, 2.5 μs is after turn-off of its internal MOSFET.

Transformer T1's (126) secondary winding is rectified by D7 (127), a Schottky barrier-type diode, and filtered by C7 (131) and C8 (132). In this application, C7 and C8 have sufficiently low ESR characteristics to allow meeting the output voltage ripple requirement without adding an LC post filter. However, post filter L3 (134), C9 (136) was employed to reduce ripple less than 100 mV. Resistor R7 (129) and capacitor C6 (128) dampen high-frequency ringing and reduce the voltage stress on D7 (127). It will be noted that bias winding 139 is used to sense the output voltage of circuit 99, and feedback resistors R5 (118) and R6 (119) are selected using standard 1% resistor values to center both the nominal output voltage and constant current regulation thresholds. Resistor R8 (133) provides a minimum load to maintain output regulation when the output is an unloaded state. The resultant voltage (Vcc) at connector 138 is 5.0 Volts DC at 1 amp, ±0.25 volts.

Sub-circuit 98 takes regulated DC voltage generated by sub-circuit 97 at connector 138 and produces an audio tone via an operational amplifier 141. Essentially, circuit 98 is a tuned oscillator. The circuit 98 uses two T-filters tuned to a discrete frequency as shown using the specified element values, preferably in this case optimized for 21 kHz. The audio signal is transferred over a standard 3.5 mm audio cable 18 via connectors 142. In the headphones 21, the 21 kHz signal is rectified and regulated using the same electronics 78 shown in FIG. 4. This allows a user to simply plug in the headphones into wall module 31 using the standard headphone audio cable 18 and charge or power the headphones 24 without adding additional electronics to the headphone pursuant to FIG. 1A.

While I have shown my invention in one form, it will be obvious to those skilled in the art that it is not so limited but is susceptible of various changes and modifications without departing from the spirit thereof.

Having set forth the nature of the invention, what is claimed is:

1. An apparatus for supplying power to a pair of headphones from the audio jack of a mobile device having the capability to output an electronic audio music signal through said audio jack, comprising:

a. a connector and wire adapted to couple with the output audio port of said mobile device and electrically connecting said mobile device and said headphones together;

b. said mobile device including means for generating a 20-22 kHz audio tone and combining it with said audio music signal to form a dual component audio signal, said generating means including means for transmitting said dual component audio signal over said connector and wire to said headphones;

c. means electrically connected to said headphones for converting said 20-22 kHz audio signal portion in said dual component audio signal into direct current power and supplying said direct current power to said headphones; and, d. wherein said conversion means comprises:

i. a high pass filter for receiving said dual component audio signal and filtering out said audio music signal portion;

ii. a pair of micro-transformers connected to the output of said high pass filter for stepping up the voltage of said 20-22 kHz audio signal;

iii. an field effect transistor bridge for converting said stepped up 20-22 kHz signal into direct current;

iv. at least one capacitor connected to the output of said field effect transistor bridge;

v. a Schottky diode connected to the output of said field effect transistor bridge for preventing return discharge; and, vi. an output lead connected to the output of said Schottky diode and connected to said headphones for powering same.

2. An apparatus as recited in claim 1, wherein said dual component audio signal further comprises a left and a right audio music signal and wherein said apparatus comprises two conversion means, one for converting said left audio music signal and the other for converting said right audio music signal.

3. An apparatus as recited in claim 1, further comprising a low pass filter for filtering out said 20-22 kHz tone from said dual component audio signal and passing said audio music signal to said headphones for converting said audio music signal into a human perceivable sonic waveform.

4. An apparatus as recited in claim 3, wherein said means for generating said dual component audio signal comprises a software application running on said mobile device and adapted for mixing a 20-22 kHz tone into said audio music signal for output through said audio jack.

5. An apparatus as recited in claim 4, further comprising positioning said conversion means on said headphones.

6. An apparatus as recited in claim 4, further comprising positioning said conversion means within said connector.

7. An apparatus for supplying power to a pair of headphones from the audio jack of a mobile device having the capability to output an electronic audio music signal through said audio jack, said apparatus optimized for telephony communications, comprising:

a. A connector and wire adapted to couple with the output audio port of said mobile device and electrically connecting said mobile device and said headphones together;

b. said mobile device including means for generating an audio signal just above the audible range and combining it with said audio signal between 300 Hz and 3400 Hz to form a dual component audio signal, said generating means including means for transmitting said dual component audio signal over said connector and wire to said headphones;

c. means electrically connected to said headphones for converting said audio signal portion just above the audible range in said dual component audio signal into direct current power and supplying said direct current power to said headphones; and, d. wherein said conversion means comprises:

i. filter means for receiving said dual component audio signal and filtering out said audio music signal portion;

ii. means connected to the output of said filter means for stepping up the voltage of said audio signal just above the audible range;

iii. means for converting said stepped up audio signal just above the audible range into direct current;

iv. at least one capacitor connected to the output of said direct current conversion means;

v. means connected to the output of said direct current conversion means for preventing return discharge; and, vi. an output lead connected to said headphones for powering same.

8. A method for supplying power to a pair of headphones from the audio jack of an electronic device optimized for telephony communications, comprising the steps of:

a. transmitting an electrical signal from said electronic device to a pair of powered headphones through a wire between the two, wherein said electrical signal comprises an audible component having a frequency between 300 Hz and 3400 Hz and a non-audible component having a frequency just above 20 kHz to form a dual component electrical signal;

b. extracting said non-audible component from said transmitted dual component electrical signal;

c. converting said non-audible component into direct current for powering said headphones;

d. wherein said converting step comprises:

i. receiving said dual component audio signal and filtering out said audible signal component;

ii. stepping up the voltage of said non-audible signal component;

iii. converting said stepped up non-audible signal component into direct current;

iv. preventing return discharge resulting from said step of converting said stepped up non-audible signal component into direct current; and, v. powering said headphones with said direct current; and, e. converting said audible component into a human perceivable sonic waveform.

* * * * *